US009010121B2

(12) United States Patent
Taylor et al.

(10) Patent No.: US 9,010,121 B2
(45) Date of Patent: Apr. 21, 2015

(54) COMBUSTION CHAMBER

(75) Inventors: Robert A J Taylor, Derby (GB); Marcus Foale, Swadlincote (GB)

(73) Assignee: Rolls-Royce plc, London (GB)

( * ) Notice: Subject to any disclaimer, the term of this patent is extended or adjusted under 35 U.S.C. 154(b) by 568 days.

(21) Appl. No.: 13/314,866

(22) Filed: Dec. 8, 2011

(65) Prior Publication Data

US 2012/0144835 A1 Jun. 14, 2012

(30) Foreign Application Priority Data

Dec. 10, 2010 (GB) ..... 1020910.4
Dec. 13, 2010 (GB) ..... 1021058.1

(51) Int. Cl.
*F23R 3/06* (2006.01)
*F23R 3/00* (2006.01)

(52) U.S. Cl.
CPC . *F23R 3/06* (2013.01); *F23R 3/002* (2013.01); *F23R 2900/03042* (2013.01)

(58) Field of Classification Search
CPC ..... F23R 3/04–3/08; F23R 2900/030402; F23R 3/02
USPC ..... 60/754, 755, 758, 760, 757; 431/351, 431/352; 110/336–340
See application file for complete search history.

(56) References Cited

U.S. PATENT DOCUMENTS 3,019,605 A * 2/1962 Reginald ..... 60/759
3,303,645 A * 2/1967 Ishibashi ..... 60/755
4,132,066 A * 1/1979 Austin et al. ..... 60/752
4,622,821 A * 11/1986 Madden ..... 60/757
4,653,279 A * 3/1987 Reynolds ..... 60/755
4,875,339 A * 10/1989 Rasmussen et al. ..... 60/760
4,887,432 A * 12/1989 Mumford et al. ..... 60/759
5,187,937 A * 2/1993 Stevens et al. ..... 60/752
5,501,071 A * 3/1996 Ansart et al. ..... 60/752
5,687,572 A 11/1997 Schrantz et al.
7,059,133 B2 6/2006 Gerendas
2002/0189260 A1* 12/2002 David et al. ..... 60/752
2003/0182942 A1 10/2003 Gerendas
2003/0227107 A1 12/2003 Stewart
2005/0086940 A1 4/2005 Coughlan, III et al.

FOREIGN PATENT DOCUMENTS

EP 0 937 946 A2 8/1999
EP 1 235 032 A2 8/2002

OTHER PUBLICATIONS

Mar. 24, 2011 Search Report issued in British Application No. 1021058.1.

* cited by examiner

*Primary Examiner* — Ted Kim
(74) *Attorney, Agent, or Firm* — Oliff PLC

(57) ABSTRACT

A combustion chamber has an outer wall supporting a number of wall elements or tiles. The tiles are located on the wall by bosses so that a cooling space is provided between the wall and the tiles. Air holes are provided through the wall and the tiles and a flow passage is provided adjacent the air holes. A flow passage is defined by changing the profiles of the air holes in the outer wall and/or the location features to provide a localized gap through which cooling air is directed to cool regions subject to overheating and extend service life.

7 Claims, 3 Drawing Sheets

COMBUSTION CHAMBER

Figure 1:
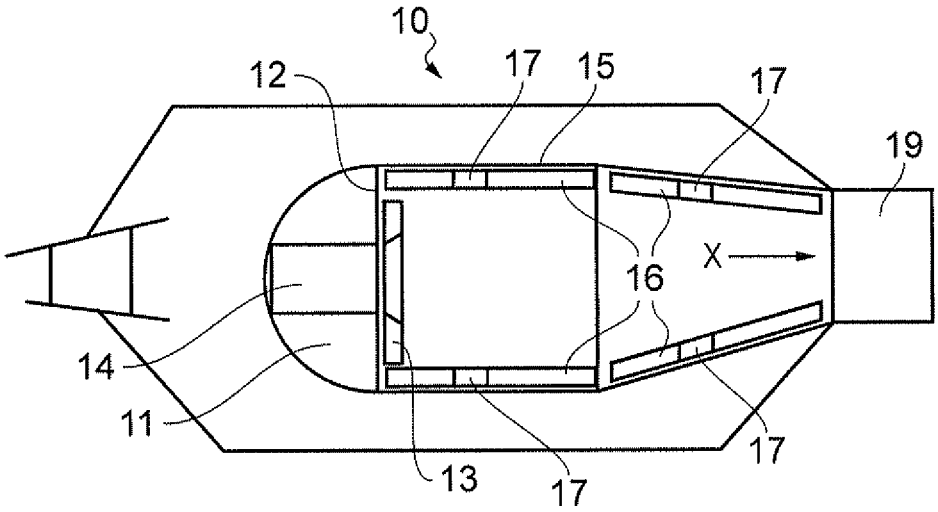
FIG. 1 (Prior Art)

This invention claims the benefit of UK Patent Application No. 1020910.4, filed on 10 Dec. 2010, and UK Patent Application No. 1021058.1, filed on 13 Dec. 2010, each of which is hereby incorporated herein in its entirety.

The present invention relates to a combustion chamber and in particular to a tiled combustion chamber for use in a gas turbine engine.

A typical combustion chamber for a gas turbine engine includes a generally annular chamber having a plurality of fuel injectors at the upstream end or head of the chamber. Air is provided into the combustion chamber through the head and also through air ports provided in the walls of the chamber. The fuel and air mix in the chamber and are combusted. The combustion products then pass out of the combustion chamber into the turbine.

Tiled combustion chambers are known in which a number of discrete wall elements or tiles are attached to the inner surface of a wall of the chamber. The tiles are supported by the wall of the combustion chamber and act to shield the combustion wall from the combustion flame and the intense temperatures reached during the combustion process.

In tiled combustors the air is introduced into the combustion chamber through discrete ports or holes, which extend through both the combustion wall and the tiles.

U.S. Pat. No. 7,059,133 B2 discloses a tiled combustor in which the air holes in the combustion wall are considerably larger than the air holes in the tiles. The hole in the tile acts as a restricting orifice, through which the air enters the combustion chamber, To avoid leakage of the airflow between the inner wall of the combustion chamber and the tile, a thickened region or boss is provided around the air holes in the tile. However in operation hot spots have occurred on the tile downstream of the air holes in the region of the boss. These localised hot spots have resulted in cracking and oxidation of the tile adjacent to the boss, which limits the service life of the component.

The present invention thus seeks to provide an improved cooling arrangement for a tiled combustor which overcomes the aforementioned problem.

According to the present invention a gas turbine combustion chamber comprises an outer and an inner wall having a space there between, the outer wall supports the inner wall which includes a number of wall elements and co-axial air holes are provided respectively through the outer wall and the inner wall elements, a location feature is provided co-axial with each air hole in each inner wall element to locate the inner wall element on the outer wall, wherein a flow passage is defined between a periphery of the air holes in the outer wall and an outer periphery of the locating feature to direct cooling air into the space between the outer and inner casing walls.

By providing a flow passage adjacent to the air holes, cooling air is directed between the outer and inner walls to cool the regions subject to overheating. This prevents the wall elements cracking and extends their service life.

The flow passage may be defined by either extending the air hole in the outer wall past the location feature on the wall elements of the inner wall or alternatively by reducing the profile of the location features.

By changing the profile of the air hole in the outer wall or the profile of the location feature on the inner wall element a localised gap is provided which directs air between the outer and inner walls.

In the preferred embodiment of the present invention part of the air holes in the outer wall are extended and the corresponding part of the location features on the inner wall elements are truncated to provide the flow passage.

Preferably the air holes in the outer wall are extended in the direction of the gas flow through the combustion chamber. This ensures that the hot spots downstream of the air holes are cooled to prevent overheating.

The profile of the air holes in the outer wall and the location features may be asymmetrical and the location features may be bosses provided around the air holes.

Preferably the air holes in the outer wall have a larger diameter than the air holes in the inner wall elements.

Figure 2A:
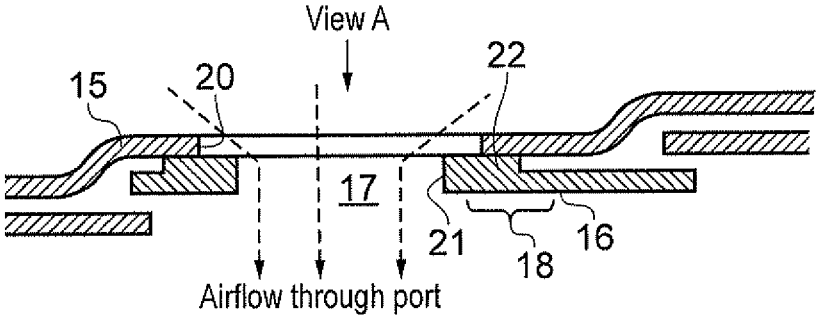
FIG. 2A (Prior Art)
Figure 2B:
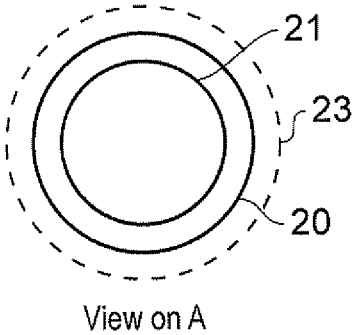
FIG. 2B (Prior Art)

The present invention will now be described with reference to the figures in which;

FIG. 1 is a schematic side view of gas turbine combustion chambers having combustion chamber tiles according to the state of the art;

FIG. 2*a* is a sectional view of part of a tiled combustion chamber in accordance with the state of the art;

FIG. 2*b* is view on arrow A in FIG. 2*a;*

Figure 3:
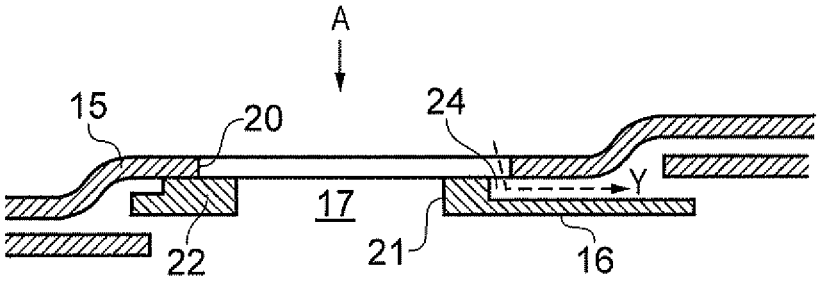
Figure 4A:
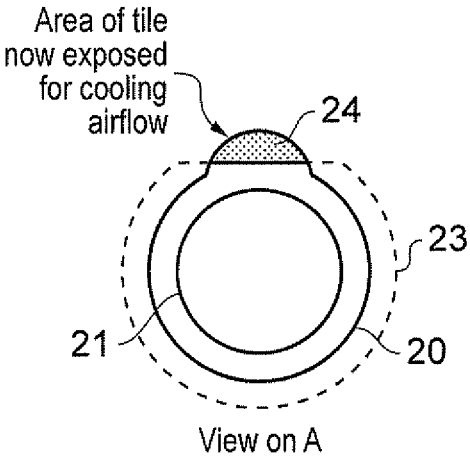
Figure 4B:
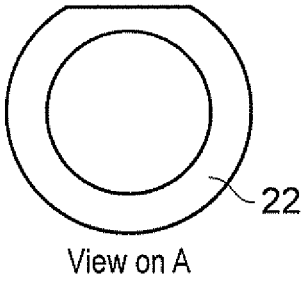
Figure 5A:
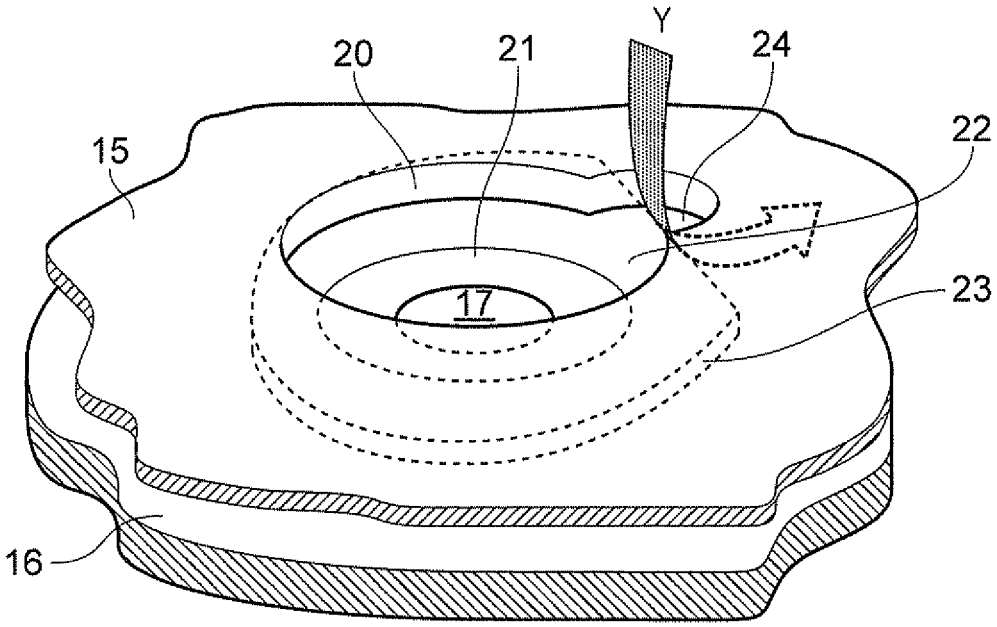
Figure 5B:
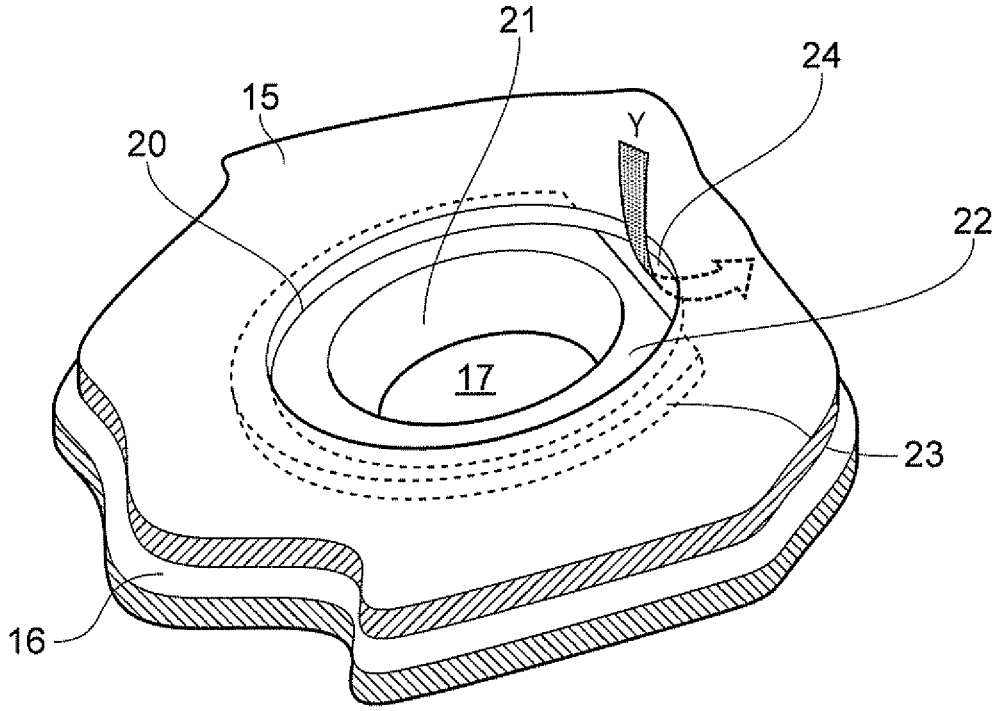

FIG. 3 is a sectional view of part of a tiled combustor in accordance with a first embodiment of the present invention;

FIG. 4*a* is a view on arrow A in FIG. 3;

FIG. 4*b* is a detailed view of part of the tile port of a tiled combustor in accordance with a second embodiment of the present invention;

FIG. 5*a* is a partial, perspective view of the tiled combustor of FIG. 3; and FIG. 5*b* is a partial, perspective view of a tiled combustor incorporating the tile port of FIG. 4*b*.

Referring to FIG. 1 a tiled combustion chamber generally indicated at 10 includes a combustor head 11 in which is located a base plate 12. A heat shield 13 is attached to the base plate 12 and has an opening through which a burner 14 extends. The combustor wall 15 supports combustion wall elements 16 in the form of tiles. Air ports 17 are provided through the combustor wall 15 and the tiles 16.

In operation fuel is fed as a spray into the combustion chamber 10 through the burner 14. Air is introduced into the combustion chamber 10 through the head 11 and through a multiplicity of air ports 17 which extend through the combustor wall 15 and the tiles 16. The fuel and air mix, and the mixture is ignited. The combustion gases flow through the combustion chamber 10 in the direction of arrow X and exit via turbine nozzle guide vanes 19.

FIG. 2*a* shows the wall construction of the combustion chamber 10 of FIG. 1 in more detail. The outer wall 15 supports a plurality of combustion wall elements or tiles 16. The tiles 16 form an inner wall which acts to shield the outer wall 15 from the combustion flame and the intense temperatures reached during the combustion process.

Air is introduced through discrete ports 17 which comprise an air hole 20 which extends through the outer wall 15 and a further air hole 21 which extends through the tiles 16.

The air holes 20 in the outer wall 15 are considerably larger than the air holes 21 in the tiles 16. The air holes 21 in the tiles 16 thus act as a restricting orifice through which the air enters the combustion chamber 10.

A location feature 22 is provided adjacent the air holes 21 in the tiles 16, which locates the tiles 16 on the outer wall 15. The region of the tile 16 adjacent the air hole 21 is thickened to form a boss 22 which not only locates the tile 16 on the outer wall 15 but also defines an air gap between the outer wall 15 and the tile 16, for cooling purposes.

As shown in FIG. 2*b* the outer diameter 23 of the boss 22 is larger than the diameter of the air hole 20 in the outer wall 15.

Problems have however been encountered with the prior art arrangement shown in FIGS. 1 and 2. In operation hot spots have occurred on the tile 16, downstream of the air holes 21, in the region 18 adjacent the boss 22. These localised hot spots have resulted in cracking and oxidation of the tiles 16 and limit the service life of the tiles 16.

FIGS. 3 to 5 show two embodiments of a combustion chamber in accordance with the present invention which overcomes the aforementioned problem.

In a first embodiment of the invention, as shown in FIGS. 4*a* and 5*a*, part of the periphery of the air hole 20 in the outer wall 15 is extended past the outer diameter 23 of the boss 22. The outer diameter 23 of the boss 22 is also truncated in this region to produce a localised gap which acts as a flow passage 24 leading to the space between the outer wall 15 and the tile 16.

In operation, cooling air passes through the flow passage 24 in the direction shown by arrow Y in FIGS. 3 and 5*a*. This flow of cooling air then passes into the space between the outer wall 15 and the tile 16 and acts to cool any hot spots.

Alternatively, in a second embodiment of the invention, as shown in FIGS. 4*b* and 5*b*, the outer diameter 23 of the boss 22 is truncated so as to extend across the periphery of the air hole 20 in the outer wall 15 to thereby produce a localised gap which acts as a flow passage 24 leading to the space between the outer wall 15 and the tile 16.

By locally shaping the air holes 20 in the outer wall 15 and/or the location features 22 on the tiles 16, a flow of cooling air can be directed to any regions where the tiles 16 are prone to overheat. By directing a flow of cooling air to those regions prone to overheating, a significant temperature reduction can be achieved and this improves the life of the components.

It will be appreciated by one skilled in the art that the cooling holes 20 and 21 and the location features 22 may be any shape and that their profiles may be changed to provide a flow passage 24 and ensure sufficient cooling air is provided to any region where overheating occurs.

What is claimed is:

1. A combustion chamber comprising:

an outer and an inner wall having a space there between, the inner wall having an inwardly facing surface, the outer wall supporting the inner wall which includes a number of wall elements;

co-axial pairs of air circular holes being provided respectively through the outer wall and the inner wall elements, the air hole in the outer wall having a segment-shaped projection; and a location feature being provided co-axial with the air hole in each inner wall element to locate the inner wall element on the outer wall, the location feature having an outwardly facing surface, the outwardly facing surface of the location feature being positioned against and inwardly of the inwardly facing surface of the inner wall, an outer periphery of the location feature being truncated adjacent to the segment-shaped projection, the location feature being integrally formed with the inner wall element, wherein a flow passage is defined between a periphery of the air hole in the outer wall and an outer periphery of the location feature, to direct cooling air into the space between the outer and inner casing walls, the flow passage being defined by the segment-shaped projection of the air hole in the outer wall and the adjacent truncated outer periphery of the location feature on the inner wall elements.

2. A combustion chamber as claimed in claim 1 in which the segment-shaped projection of the air holes in the outer wall are projecting in the direction of the gas flow through the combustion chamber.

3. A combustion chamber as claimed in claim 1 in which the profile of the air holes in the outer wall and the location features are asymmetrical across at least one axis extending through a center of the air holes in the outer wall.

4. A combustion chamber as claimed in claim 1 in which the location features are bosses.

5. A combustion chamber as claimed in claim 1 in which the air holes in the outer wall have a larger diameter than the air holes in the inner wall elements.

6. A combustion chamber as claimed in claim 1, wherein remaining parts of the air hole in the outer wall, other than the segment-shaped projection of the air hole, do not extend in the outwardly radial direction past the outer periphery of the location feature on the inner wall elements.

7. A combustion chamber as claimed in claim 1, wherein the profile of the air holes in the outer wall and the location features are asymmetrical across a lateral axis of the air holes that does not extend through the defined flow passage.

* * * * *